United States Patent [19]

Terashima

[11] 4,014,608

[45] Mar. 29, 1977

[54] DEVELOPING APPARATUS FOR ELECTROPHOTOGRAPHIC COLOR COPYING APPARATUS

[75] Inventor: Isamu Terashima, Hitachi, Japan

[73] Assignee: Hitachi, Ltd., Japan

[22] Filed: June 13, 1975

[21] Appl. No.: 586,820

[30] Foreign Application Priority Data

June 26, 1974 Japan ..... 49-72307

[52] U.S. Cl. ..... 355/4; 118/DIG. 23; 355/10

[51] Int. Cl.[2] ..... G03G 15/01

[58] Field of Search ..... 355/10, 4; 96/1 LY, 96/1.2; 118/DIG. 23; 427/17

[56] References Cited

UNITED STATES PATENTS

| | | | |
|---|---|---|---|
| 3,799,791 | 3/1974 | Kobilas | 355/10 X |
| 3,808,025 | 4/1974 | Fukushima et al. | 355/10 X |

*Primary Examiner*—Richard L. Moses
*Attorney, Agent, or Firm*—Craig & Antonelli

[57] ABSTRACT

A recording medium with electrostatic latent images thereon is developed in a developer. A pair of intermediate rollers are provided in the developer. The rollers act to temporarily remove squeezably the developer on the surface to be developed of the recording medium as the recording medium is processed in the developer.

2 Claims, 2 Drawing Figures

DEVELOPING APPARATUS FOR ELECTROPHOTOGRAPHIC COLOR COPYING APPARATUS

BACKGROUND OF THE INVENTION

1. Field of the Invention

The present invention relates to a developing apparatus and, more particularly, to an improvement over the developing apparatus of the type using a liquid developer with toner dispersed therein.

2. Description of the Prior Art

It is a common practice that an electrostatic latent image formed on the surface of a recording medium is processed in the developer including colored toners for the purpose of turning the latent image into a visible image. In such process, when the recording medium with electrostatic latent image on the surface is immersed in the developer, the electrostatic force causes the colored toners to be fixed on the surface of the recording medium, with the result that the latent image of electrostatic charges is colored to be visible. Such principle of development has widely been used in the electronic copying machine, and one form of such is disclosed in the U.S. Pat. No. 3,848,990, issued on Nov. 19, 1974, by Osamu Otsubo et al. In the copying machine of this type, the way to form the latent image on the recording medium is generally classified into two ways: One of them is that the recording medium per se is coated thereon with photoconductive material and the latent image is directly formed thereon; the other is that the latent image once formed on the sensitive means, such as a sensitive plate, is transferred onto the another surface, such as a sheet of paper. The developing apparatus is generally comprised of developer including colored toners, a developing trough where the development takes place, a tank for developer, and the like. In multicolor development, such developing apparatus is provided for each color used. When considering the development taking place in the just-mentioned developing apparatus, the electrostatic force of the charges of the latent image exerts on the paper in a narrow range as the recording medium passes through the developer. This range can be extended by increasing the amount of the electrostatic charges, and yet the effective electrostatic force can be at present heightened to be in the order of several hundreds micron at most. As a result, the colored tonors distanced from the recording medium beyond the region do not contribute to the development taking place in the developer, although the colored toners are included in the same developer. The amount of the colored toners existing in the region where there is only several hundreds micron is insufficient to obtain a satisfactory process of development. For this reason, in practical development work, an attempt has been made whereby the developer is constantly circulated by using a pumping means for refreshing the developer in the vicinity of the surface of the recording medium. However, the result of such attempt felt short of expectations. That is, the old developer residing close to the recording medium forms so-called boundary layers along the surfaces thereof due to the viscosity of the developer and thus only a small amount of old developer is exchanged in this vicinity, which results in the necessity for a long developing operation period for satisfactory quality of development.

SUMMARY OF THE INVENTION

Accordingly, an object of the present invention is to provide a developing apparatus with a high efficiency of development.

Another object of the present invention is to provide a developing apparatus of small size.

Still another object of the present invention is to provide a developing apparatus being suitable for developing a color picture.

A principal feature of the present invention resides in that the developer contacting the surfaces of the recording medium during developing process is temporarily removed therefrom to ensure that such developer is refreshed.

Other objects and features of the present invention will be apparent from the following description taken in connection with the accompanying drawings.

DESCRIPTION OF THE PREFERRED EMBODIMENTS

Figure 1:
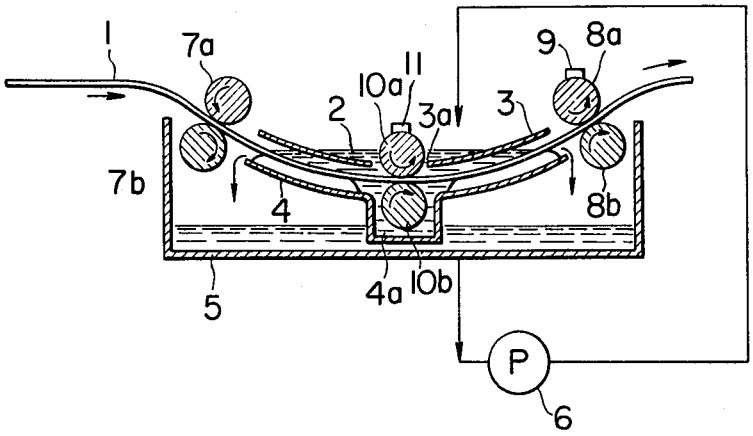
FIG. 1 is a horizontal sectional view of a monochromatic developing apparatus according to the present invention.

In FIG. 1, reference numeral 1 designates a recording medium with latent images of electric charges thereon. There are two ways to form this latent images of charges, as previously stated. The first is that they are formed directly on the recording medium. The second is that the latent images once formed on the recording medium are transferred onto another one. In this instance, either way may be permitted in use. A developing apparatus incorporating the present invention is comprised of the following: Developer 2 including colored toners; an electrode 3 with a slit 3*a* at the center; a developing trough 4 with a U-shaped recess 4*a* disposed at the position opposite to the slit 3*a;* a tank 5 for containing the developer 2; a pump 6 for recirculating the developer for refreshing and mixing; a pair of feeding rollers 7*a* and 7*b;* a pair of squeezing rollers 8*a* and 8*b;* a cleaning pad 9 urged against one of squeezing rollers 8*a* and 8*b;* a pair of intermediate rollers 10*a* and 10*b* disposed in the space defined by the slit 3*a* and the recess 4*a;* and another cleaning pad 11 urged against one of the intermediate rollers 10*a* and 10*b*. The respective rollers 7*a*, 8*a* and 10*a* are preferably made of metal or plastic, while the respective rollers 7*b*, 8*b* and 10*b* preferably made of resilient material such as rubber. It is desirable that, when plastic is used for the former group of rollers, the charge of the rollers 8*a* and 10*a* which is accomplished by frictional rubbing with the corresponding cleaning pads 9 and 11 is the same as the colored toners in polarity.

In such constructed developing apparatus, the recording medium 1 is developed in the region preceding the intermediate rollers 10*a* and 10*b* as it progresses in the developer 2. The developed recording medium 1 enters into the nip of the intermediate rollers 10*a* and 10*b* where the developer contacting the surfaces of recording medium 1 is temporarily removed squeezably. The recording medium 2 emanating from the intermediate rollers 10*a* and 10*b* is redeveloped in the region following the intermediate rollers 10*a* and 10*b*, since the recording medium shifts again in the developer, being brought its surfaces into contact with the developer. According to this developing process, the developer layer formed on the surface to be developed of the recording medium 1 is substantially refreshed through the squeezing operation of the intermediate rollers 10*a* and 10*b*, so that a satisfactory amount of colored toners may be supplied to the surface to be developed of the recording medium 1. More precisely, the concentration of the colored toners in the developer layer formed on the developing surface of the recording medium 1 running prior to the intermediate rollers 10*a* and 10*b* is caused to degrade due to the fact that the colored toners in this layer are affixed on the developing surface of the recording medium for forming the electrostatic latent image. However, this developer layer with degraded concentration of colored toner is removed from the developing surface of the recording medium when it passes through the intermediate rollers 10*a* and 10*b*. After leaving the intermediate rollers 10*a* and 10*b*, the recording medium 1 receives on the developing surface a new developer with a high concentration of colored toners, and thus a new layer of developer is again formed on the developing surface. Experiment conducted by the present inventor have shown that the developing apparatus of this instance exhibits about twice as compared with the conventional one with respect to a development efficiency which is defined as a ratio of a maximum picture concentration to an effective developing time. Therefore, the size of the developing trough of the present invention required for obtaining a predetermined quality of developing is about one-half that of the conventional one.

The above-described developing apparatus is also effective to enhance the developing efficiency when applied to the monochromatic development, while it is effective to obtain a good color tone when applied to the multicolor development.

Figure 2:
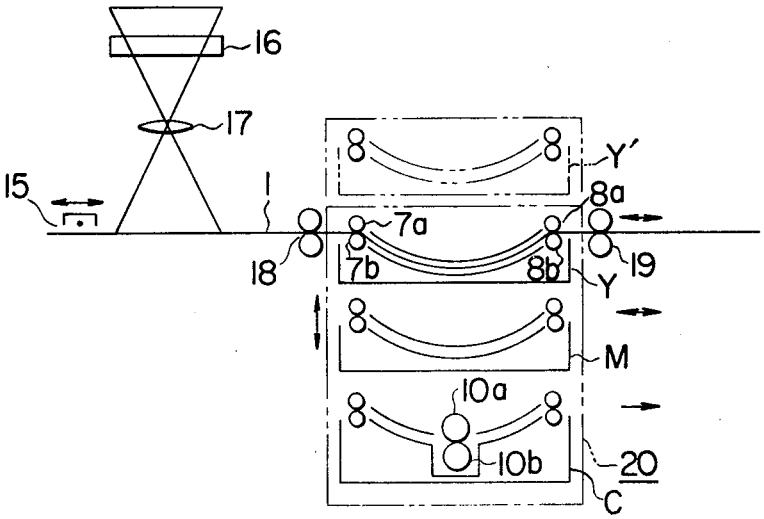
FIG. 2 is a horizontal sectional view of a multicolor electrophotographic apparatus according to the present invention.

The multicolor development will now be described with reference to FIG. 2. In the figure, reference numeral 15 designates a charging means, numeral 16 a color resolution filter, numeral 17 a lens, numerals 18 and 19 pairs of guide rollers, respectively, and these components cooperate to charge uniformly the recording medium 1, to expose the charged recording medium with color resoluted lights and to feed it to a developing apparatus 20. The developing apparatus 20 includes a yellow developing means Y, a magenta developing means M and a cyan developing means C, and these means are successively superposed and movable as one body in upward and downward directions. As seen from the figure, the yellow developing means Y and the magenta developing means M are constructed in the same manner as the conventional one, while the cyan developing means C has the same construction as the FIG. 1 development. A drive means (not shown) for driving the recording medium is constructed to reciprocately move the recording medium relative to a developing means, i.e. such that it operates to enter the recording medium 1 into and pull back from the yellow and the magenta developing means Y and M, after which to enter it into the cyan developing means C and draw out of it after passing therethrough. The relative moving speed of the recording medium to the cyan developing means C is established about one half those of the yellow and the magenta developing means Y and M. It is evident that the recording medium 1 may be disposed stationary while the developing means are arranged to be movable.

In operation, the recording medium 1 is fairly uniformly charged by the charging means 15, and then it is subjected to an illumination through the filter 16 for yellow development. After this exposure, the recording medium 1 is entered into the yellow developing means Y for effecting the yellow development. In this case, the recording medium is fed into the developing means Y until the exposed portion thereof passes that developing means for uniformity of the developing surface. Following this, the recording medium 1 is pulled back to the original position of exposure. The recording medium 1 with the yellow development completion is uniformly charged by means of the charging mean 15 and is subjected to an exposure for magenta development through the filter 16. The development of the recording medium after thus exposure is carried out in a similar manner. In this case, before the magenta development but after the yellow development, the magenta developing means M is lifted up, by means of a driving mechanism (not shown), to align with guide rollers 18 and 19 for preparation of the magenta development. Finally, with respect to the cyan development, the similar process of charging and monochromatic exposure for cyan development through the filter 16, is applied thereto, and then is fed to the cyan developing means C for the cyan development. In this case, the traveling rate of the recording medium 1 is one half of those of the previous case, and the cyan development of the recording medium 1 is carried out in the developing trough being subjected to the squeezing operation of the intermediate rollers 10*a* and 10*b*, and then the developed recording medium 1 is fed to the exterior, through the guide rollers 19.

The development just mentioned enables those colors of yellow, magenta and cyan to be substantially uniformly developed thereby obtaining harmonized color pictures. This results from the fact that the intermediate rollers 10*a* and 10*b* in the cyan developing means C execute the function equivalent to those of the yellow and the magenta developing means Y and M. That is, the use of the intermediate rollers 10*a* and 10*b* permits the recording medium 1 to travel in the cyan developing means C (the last developing means) in a unidirectional mode thereby to facilitate the feeding-out of the recorded recording medium 1.

I claim:

1. A developing apparatus for a color picture comprising a plurality of developing means each moving relative to a recording medium with electrostatic latent images thereon, each developing means being provided at the intake and the exit with rollers, means for reciprocately moving said recording medium, according to the order of the successively arranged colors to be developed, relative to said respective developing means and also for moving said recording medium in a unidirectional mode relative to said developing means corresponding to the last color to be developed; said developing means corresponding to the last color to be developed being provided therein with means for temporarily removing the degraded developer on the surface of said recording medium.

2. An apparatus according to claim 1, in which the relative speed of said recording medium to said developing means corresponding to the last colors to be developed is about one half those of said recording medium to said other developing means.

* * * * *